United States Patent [19]

Cohen

[11] 4,265,242

[45] May 5, 1981

[54] FILTER DEVICE FOR INJECTABLE FLUID

[76] Inventor: Milton J. Cohen, 10823 Burbank Dr., Potomac, Md. 20854

[21] Appl. No.: 59,670

[22] Filed: Jul. 23, 1979

[51] Int. Cl.[3] ..... A61J 1/00

[52] U.S. Cl. ..... 128/272; 215/247

[58] Field of Search ..... 128/272, 272.1, 272.3; 222/490; 215/DIG. 3, 311, 247, 248

[56] References Cited

U.S. PATENT DOCUMENTS

| | | | |
|---|---|---|---|
| 1,206,661 | 11/1916 | Booth | 222/490 |
| 2,191,447 | 2/1940 | Beardsley | 128/272 U |
| 2,393,578 | 1/1946 | Waite | 215/248 |
| 3,105,613 | 10/1963 | Barton et al. | 128/272 |

FOREIGN PATENT DOCUMENTS

| | | | |
|---|---|---|---|
| 644623 | 3/1964 | Belgium | 128/272 |

*Primary Examiner*—Robert W. Michell
*Assistant Examiner*—J. L. Kruter
*Attorney, Agent, or Firm*—McDougall, Hersh & Scott

[57] ABSTRACT

A filter device for injectable fluids which includes a container in the open end of the device subdivided into a pair of sealed compartments with self sealing members in each compartment communicating the compartments with the interior of the vial, with the self sealing members being responsive to pressure differential between the interior of the vial and the particulate compartments, and filter members in each compartment through which fluid flows during passage between the vial and the compartment.

8 Claims, 4 Drawing Figures

FILTER DEVICE FOR INJECTABLE FLUID

This invention relates to a filter device for use in combination with a syringe for filtration of a fluid medium before injection to insure removal of undesirable particulates.

In my previously issued U.S. Pat. No. 4,137,917, description is made of a syringe having a filter unit embodied therein for filtration of fluid medium as it is being forced from the syringe for injection.

It is an object of this invention to provide a filter device which is simple in construction and easy in operation; which can be used with any syringe; which avoids the need for assembly of a syringe with a filter unit built in; which operates not only to filter the fluid medium to be injected but also filters the elements coming in contact with the fluid medium for enabling displacement thereof from the device thereby to avoid contamination while insuring that the fluid medium being injected remains free of undesirable materials that might otherwise become entrained.

These and other objects and advantages of this invention will hereinafter appear, and for purposes of illustration, but not of limitation, an embodiment of this invention is shown in the accompanying drawings, in which.

Figure 1:
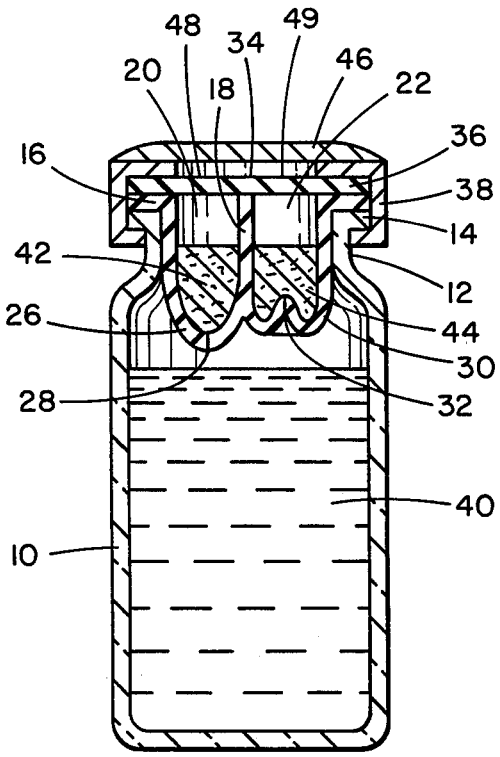
FIG. 1 is a sectional elevational view of the filter device embodying the features of this invention.

The invention is addressed to a device shown in FIG. 1 of the drawing which comprises a self contained unit assembly including a vial 10 in the form of a tubular member of glass, plastic, metal or the like fluid and vapor impervious material having an open end defined by a neck portion 12 which terminates in an outwardly extending lip flange 14.

Fitted within the open end of the vial is a carrier 16 of elastic material having a concave portion which extends downwardly through the neck portion into the vial with a wall 18 subdividing the concave portion into two separate compartments 20 and 22. The bottom wall 26 of one compartment extends curvilinearly downwardly with a slit 28 in the lowermost end portion which is self sealing in response to pressure from within the vial and which is flexed to open position in response to pressure within the compartment 20 which is greater than the pressure within the vial. The bottom wall portion 30 of the other compartment 22 is upturned to a convex curviture with a slit 32 in the upper end portion which is self sealing in response to pressure from within the compartment 22 which is greaer than the pressure within the vial and is automatically flexed to open position in response to pressure in the compartment 22 which is less than the pressure within the vial.

A sealing disc 34 spans the upper open end of the carrier member including a lip portion 36 which extends outwardly integrally from the upper end of the carrier to overlie the lip 14 of the vial. The described elements are secured in sealing relation by a crimp cap 38 which embraces the lip portions therebetween and which may be formed of a metal such as aluminum or of a plastic material.

The vial 10 is at least partially filled with the fluid medium 40 to be injected and sterile conditions are maintained by the described sealed relation.

Each compartment 20 and 22 is provided with a separate fine filter 42 and 44 respectively, which extend from wall to wall of the compartment to insure that any fluid or gasses passing through the compartment will pass through the filter. Such filter by be an ultra fine filter such as formed of metal fibers of the type used in biomedical science, blood injection or the like, or other filter medium having very fine pores.

The sealed upper end of the assembly is provided with a removable cover 46 such as a tear off aluminum cover, to protect the seal.

Figure 4:
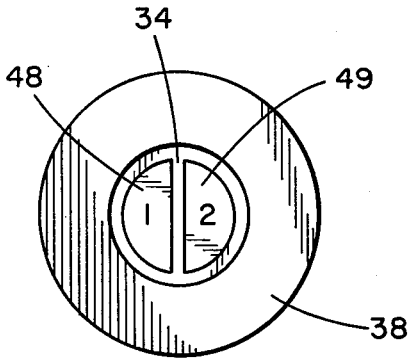
FIG. 4 is a top plan view of the device shown in FIG. 1 with the cover removed.

As illustrated in FIG. 4, the top side of the sealing disc 34 is marked by indications 48 and 49 to outline the area of the compartments for purposes of assisting and insuring proper use of the device, as will hereinafter be described.

Figure 2:
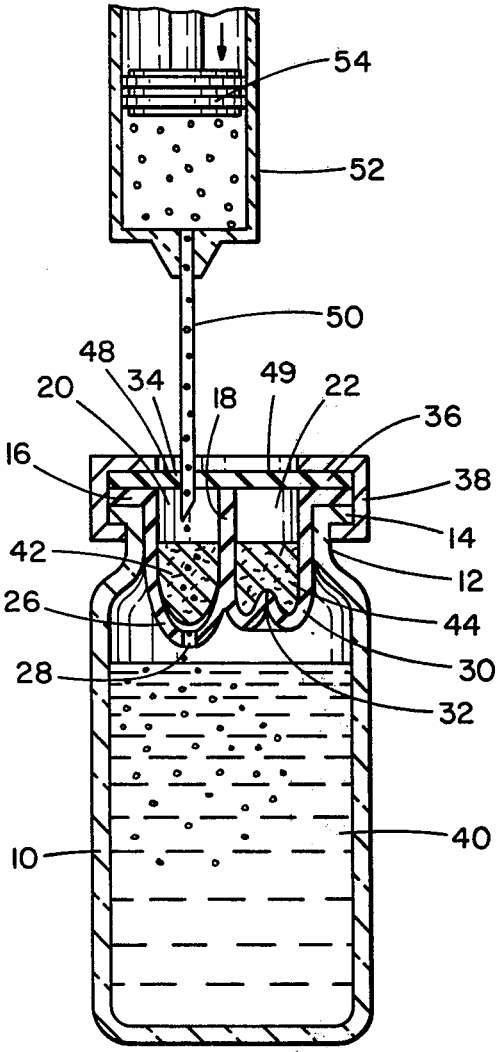
FIG. 2 is a sectional elevational view of the device shown in FIG. 1 in combination with an empty syringe in an intermediate stage of operation for introducing air or other gaseous material into the device.
Figure 3:
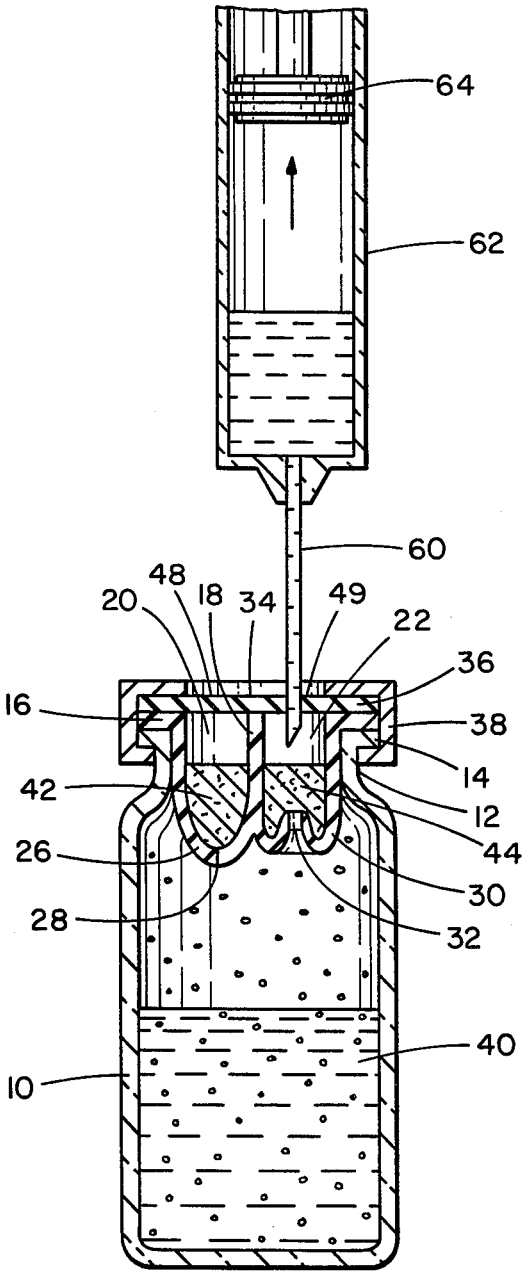
FIG. 3 is a sectional elevational view of the syringe shown in FIG. 1 illustrating the combination with an empty syringe for withdrawing fluid medium to be injected from the device.

In use, the cover 46 is removed to expose the outer face of the sealing disc 34. As illustrated in FIG. 2 the needle 50 of an empty syringe 52 is inserted through the section 48 marked with the number 1 into the first compartment and into the open space immediately above the filter 42. The plunger 54 of the empty syringe is displaced downwardly in the direction to force air from the barrel of the empty syringe 52 into the compartment 42. In response to positive pressure built up within the compartment, the self sealing slit 28 opens to enable the air to filter through the filter 42 into the vial 10, creating a positive pressure of filtered air within the vial. Upon withdrawal of the empty syringe, and in response to the greater pressure in the vial than in the compartment 20, the sealing slit closes to seal the vial with the pressurized filtered air therein.

When it is subsequently desired to inject the fluid 40 entrapped within the vial, the needle 60 of an empty syringe 62 is inserted through the sealing disc 34 in the area marked with the numeral 2 whereby the needle pierces the sealing disc and enters into the second compartment 22 in the open area just above the filter element 44.

The device is inverted so that the area occupied by the gaseous phase will be uppermost while the fluid 40 to be dispersed will be lowermost. Now, when the plunger 64 is withdrawn in the empty vial 62, a vacuum will be created within the compartment 22. The differential pressure between the compartment 22 and the vial 10 will result in opening of the slit 32 connecting the vial with the compartment to enable fluid to flow from the vial, through the filter 44 and into the compartment 22 for withdrawal by the needle into the syringe 62. When the desired amount of filtered fluid has been withdrawn, the syringe 62 can be removed and the filtered fluid injected therefrom into the desired site, while the slits 32 automatically return to the sealed relation.

It is not essential to make use of an empty syringe for injection of filtered air into the vial to enable displacement of the fluid from the vial. It would be sufficient in use, merely to pierce the seaing member 34 at position 1 and to insert an empty syringe 62 through position 2 for entry into the second compartment 22. Until the plunger is actuated for displacement in the syringe 62, the slit seals remain effective to seal the vial. However, in response to actuation of the plunger for withdrawing fluid from the vial, after the assembly has been inverted, the pressure differential between the vacuum conditions in the compartment 22 as compared to atmospheric conditions in the vial, will cause the slit 32 to open to enable fluid to flow from the vial through the filter 44 into the compartment 22 to be taken up by the syringe. Removal of fluid from the vial will operate automatically to reduce the pressure therein so that the pressure within the vial will become less than the atmospheric pressure in the compartment 20 thereby causing the slit to open and enable air to enter into the compartment and to be drawn through the filter 42 into the vial for replacement of the volume of liquid as it is being withdrawn.

It will be apparent from the above that material entering the vial and leaving the vial will be filtered so as to maintain the desired sanitary conditions and removal of particulates from the fluid to be injected.

It will be understood that different filters may be used for different purposes. The container is designed such that the two filter members 42 and 44, of a desired construction and porosity, can merely be dropped into the compartments 20 and 22 and secured therein in sealing relation with the adjacent walls, as by heat seal, sealing compound, adhesive or the like, or the filter units can be molded into the compartments.

It will be understood that changes may be made in the details of construction, arrangement and operation, without departing from the spirit of the invention, especially as defined in the following claims.

I claim:

1. A filter device for injectable fluid comprising a vial open at one end and partially filled with the injectable fluid, a sealing disc sealing the open end of the vial, a container secured in sealing relation to the open end of the vial between the sealing disc and the interior wall of the vial and extending into the neck portion of the vial, a wall subdividing the container into two compartments communicating at one end with the sealing disc which seals the compartments and having self sealing slits in the other end of each compartment, one of which opens in response to pressure differential between one compartment and the vial when the pressure in the one compartment is greater than the pressure in the vial and closes when the pressure in the one compartment is less than the pressure in the vial, and the other having means which remains sealed when the pressure in the other compartment is greater than the pressure in the vial but is opened when the pressure in the other compartment is less than the pressure in the vial, and filter means within each compartment through which the fluid or gas must flow for filtration of fluid and gas during flow through the compartments.

2. A device as claimed in claim 1 in which the separating wall extends vertically into sealing engagement with the sealing disc.

3. A device as claimed in claim 1 which includes a removable cover overlying the open end of the vial and the sealing disc.

4. A device as claimed in claim 1 in which the sealing disc is marked on its outer surface to outline the portion of each compartment in alignment therewith.

5. A device as claimed in claim 1 in which the portion of the container defining the bottom wall of the one compartment is formed with a curvilinear concave portion and the sealing disc is located in the base of said concave portion.

6. A device as claimed in claim 1 in which the portion of the container forming the bottom wall of the other compartment is formed with a curvilinear convex portion and the self sealing slit is located in the apex thereof.

7. A device as claimed in claim 1 in which the container is formed of elastomeric material.

8. A device as claimed in claim 1 in which the vial is formed of a clear vapor and fluid impervious material.

* * * * *